United States Patent [19]

Inui et al.

[11] 4,377,043

[45] Mar. 22, 1983

[54] SEMI-AUTOMATIC HYDRAULIC EXCAVATOR

[75] Inventors: Takayasu Inui; Kazuo Ootsuka; Saburo Nogami, all of Hirakata; Michiaki Igarashi, Yokosuka; Toshiaki Horikoshi, Kamakura; Kazuhiro Izumi, Isehara, all of Japan

[73] Assignee: Kabushiki Kaisha Komatsu Seisakusho, Tokyo, Japan

[21] Appl. No.: 221,564

[22] Filed: Dec. 31, 1980

[30] Foreign Application Priority Data

Jan. 7, 1980 [JP] Japan ..... 55-450

[51] Int. Cl.[3] ..... E02F 3/00; E02F 9/26

[52] U.S. Cl. ..... 37/18 R; 37/DIG. 1; 414/699

[58] Field of Search ..... 37/103, DIG. 1, 118; 414/696-701, 685, 686

[56] References Cited

U.S. PATENT DOCUMENTS

| | | | |
|---|---|---|---|
| 3,768,372 | 10/1973 | McMillen | 414/699 |
| 3,883,023 | 5/1975 | Bernhoft | 414/699 |
| 4,015,729 | 4/1977 | Parquet | 414/699 X |
| 4,288,196 | 9/1981 | Sutton | 37/103 X |

FOREIGN PATENT DOCUMENTS

| | | | |
|---|---|---|---|
| 2454523 | 5/1975 | Fed. Rep. of Germany | 37/DIG. 1 |
| 541946 | 3/1977 | U.S.S.R. | 37/DIG. 1 |
| 617546 | 7/1978 | U.S.S.R. | 37/DIG. 1 |
| 644919 | 3/1979 | U.S.S.R. | 37/DIG. 1 |
| 663794 | 5/1979 | U.S.S.R. | 37/DIG. 1 |

*Primary Examiner*—E. H. Eickholt

*Attorney, Agent, or Firm*—Spensley, Horn, Jubas & Lubitz

[57] ABSTRACT

A semi-automatic hydraulic excavator capable of automatically controlling arm and bucket angles when bringing the bucket back to the original excavation posture after completion of dumping excavated soil. For this purpose, arm and bucket angle detectors are provided therein and the automatic control is performed by negatively feeding back values detected by these detectors to minimize deviations between these values and preset values produced from arm and bucket angle setters corresponding to the arm and bucket angles in the original excavation posture. The automatic control mode is selected by a signal from an automatic control command signal producing circuit. With this system, the bucket is swiftly brought back to the original excavation posture from the dumping posture without requiring much operator's skill and efforts.

4 Claims, 2 Drawing Figures

TO ARM CYLINDER 6
TO BUCKET CYLINDER 7
TO BOOM CYLINDER 5
TO BOTTOM CYLINDER 8
TO ROTATION CYLINDER
HYDRAULIC CONTROL VALVE
AMPLIFIER
ARM ANGLE DETECTOR
BUCKET ANGLE DETECTOR
ARM ANGLE SETTER
BUCKET ANGLE SETTER
COMPARATOR
ARM LEVER
BUCKET LEVER
BOOM LEVER
BOTTOM LEVER
ROTATION LEVER
MANUAL-AUTO CHANGEOVER SWITCH

SEMI-AUTOMATIC HYDRAULIC EXCAVATOR

BACKGROUND OF THE INVENTION

This invention relates to a semi-automatic hydraulic excavator.

In hydraulic excavators such as a loading shovel and a power shovel, a number of control levers such as a boom lever, an arm lever, a bucket lever and a rotation lever are provided. An operator manually operates these control levers to control the corresponding hydraulic control valve and thereby carries out work such as excavating and dumping soil. When a sequence of work, for example, excavating soil, dumping the excavated soil into a dump truck and then bringing the bucket back into the excavation posture for another excavation is to be carried out with a loading shovel, plural operations must be conducted simultaneously, i.e. a compound operation must be performed.

In a conventional hydraulic excavator, an operator is required to carry out such compound operation, and accordingly the operator must be highly skilled and even a highly skilled operator should put forth tremendous efforts which bring about deal of fatigue. It is also disadvantageous that in a large loading shovel in the prior art it is fairly difficult to watch the movement of the bucket from the operator's seat and the bucket is likely to be destroyed by mistakenly hitting against the front part of the track thereof.

SUMMARY OF THE INVENTION

Accordingly, an object of this invention is to eliminate the above-described disadvantages in conventional hydraulic excavators.

It is another object of this invention to provide a semi-automatic hydraulic excavator wherein the control system of a hydraulic excavator is semi-automatized to such extend that after dumping the excavated soil, the arm cylinder and bucket cylinder are automatically controlled in accordance with an operation of the boom lever so as to bring the bucket back automatically to the excavation posture.

It is still another object of this invention to provide a semi-automatic hydraulic excavator capable of returning the bucket to the excavation posture with small efforts even by a low-skilled operator as well as alleviating operator's fatigue.

It is further object of this invention to provide a semi-automatic hydraulic excavator whose control device is simple in construction, easy to attach to a conventional hydraulic excavation and enables manual control as performed in a conventional excavator together with the above-described automatic control.

These and further objects, features and advantages of this invention will become more obvious from the following description when taken in connection with the accompanying drawings which show, for purposes of illustration only, one embodiment in accordance with this invention.

DETAILED DESCRIPTION OF THE INVENTION

One embodiment of a semi-automatic hydraulic excavator according to this invention is described in detail with reference to the accompanying drawings. For convenience in description, the semi-automatic hydraulic excavator is a loading shovel by way of example.

Figure 1:
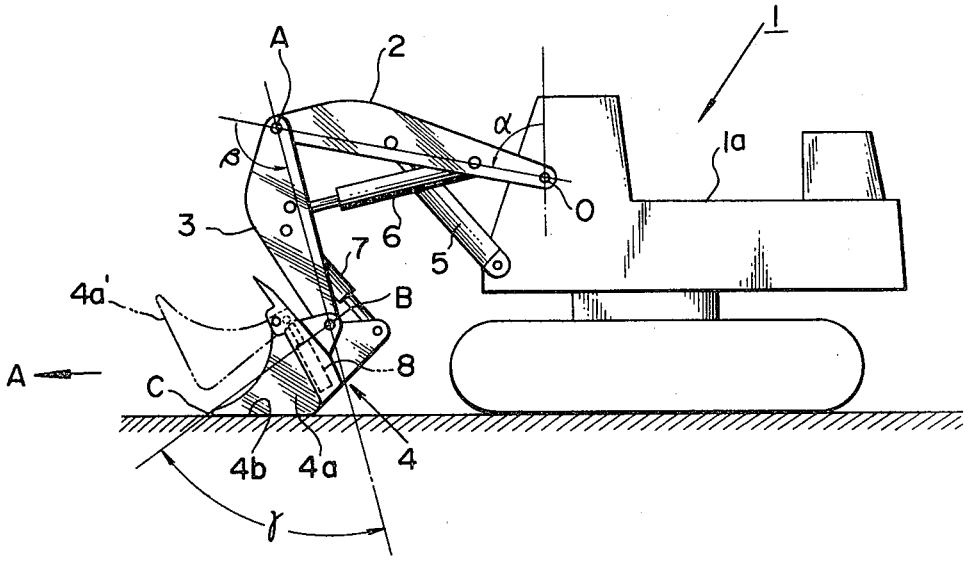
FIG. 1 is an explanatory diagram showing each part of a hydraulic loading shovel.

Referring to FIG. 1, a boom 2, an arm 3 and a bucket 4 are independently controlled by means of a boom cylinder 5, an arm cylinder 6 and a bucket cylinder 7, respectively. A bottom cylinder 8 (shown in a broken line) controls the bucket 4 so as to bring the bottom 4*a* thereof into a posture 4*a*′ (shown in a chain line) so as to split the bottom 4*a* of the bucket 4 for dumping excavated soil. In FIG. 1, rotation supporting points of the boom 2, the arm 3 and the bucket 4 are called O, A and B, respectively, and angles between a vertical surface containing the supporting point O and a line segment OA, between an extension of the line segment OA and a line segment AB, and between the extension of the line segment AB and a line segment BC are called a boom angle $\alpha$, an arm angle $\beta$ and a bucket angle $\gamma$, respectively. Point C represents the edge of the bucket 4.

In this invention, it is so designed that after dumping the excavated soil, the bucket 4 is returned to the original excavation posture by automatically controlling the arm cylinder 6 and the bucket cylinder 7 during the period when the boom cylinder 5 is manually controlled. All of the rest of the operations, namely operations for excavation work, raising the boom after excavation, rotating the rotation body 1*a* leftward (or rightward) and opening the bucket bottom are designed to be manually controlled.

Figure 2:
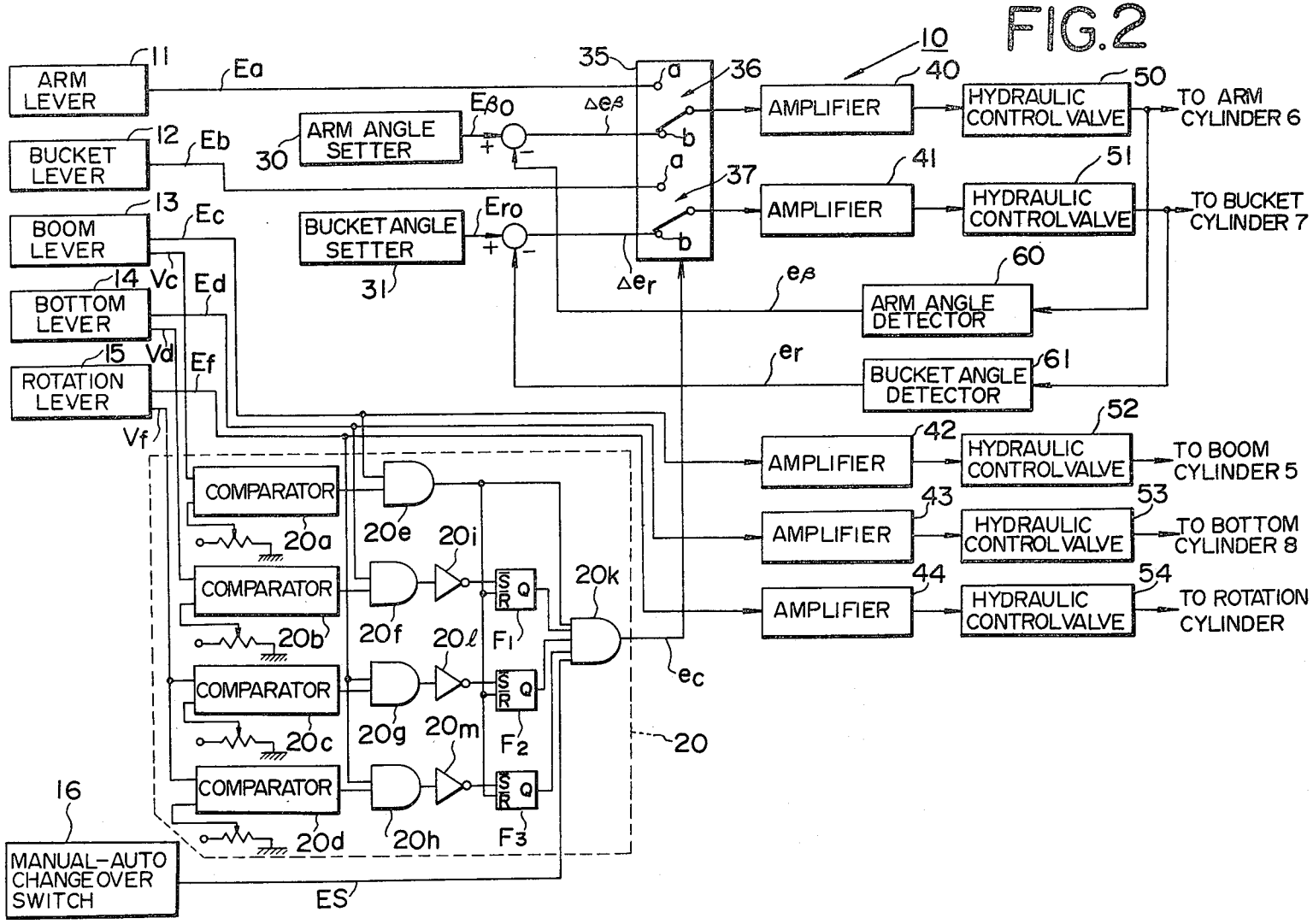
FIG. 2 is a block diagram showing one embodiment of a control device for a semi-automatic hydraulic excavator according to this invention.

Referring to FIG. 2, an arm angle detector 60 and a bucket angle detector 61 are provided at the rotation supporting points A and B of the arm 3 and the bucket 4 respectively. These arm angle detector 60 and bucket angle detector 61, which can be, for example, rotary potentiometers, respectively detect the arm angle $\beta$ and the bucket angle $\gamma$ and then output the corresponding arm angle signal $e\beta$ and bucket angle signal $e\gamma$.

Levers 11 to 15 respectively send out lever control signals Ea to Ef corresponding to the operation angle of each lever, and at the same time in case of the levers 13, 14 and 15, in particular, send out signals Vc, Vd and Vf which indicate that the lever is being operated, that is, the lever is not in the neutral position.

A manual-auto changeover switch 16 in a control device 10 is for selecting the control mode of the arm cylinder 6 and the bucket cylinder 7 from manual to automatic and vice versa and sends out signal "0" for the manual mode and "1" for the automatic mode.

A control circuit 20 sends out, when receiving the boom lever control signal Ec, the bottom lever control signal Ed and the rotation lever control signal Ef together with the boom lever operation signal Vc, the bottom lever operation signal Vd and the rotation lever operation signal Vf, an automatic control command signal $e_c$ which determines control mode in the operation of the arm 3 and the bucket 4 when bringing the bucket 4 into the original excavation posture after dumping the excavated soil. After the bucket 4 scooped up the excavated soil, raise the bucket 4 and rotate the rotation body 1*a* up to the dumping place. When the dumping place is located in the right side from the operator's seat, rotate the rotation body rightward and when the dumping place is in the left side, rotate it leftward so as to bring the bucket 4 above the dumping place. Then by operating the bottom lever 14, split the bottom of the bucket 4 so as to dump the excavated soil. After dumping, while operating the rotation lever 15 in the direction opposite to that taken previously, control the boom lever 13 downward. The automatic control command signal $e_c$ is produced from the time when the boom lever 13 starts to be operated downwardly until it stops. The rotation lever 15 is brought back to the neutral position for ending the rotation when the rotation body 1*a* comes to be directed to the original excavation posture.

An arm angle setter 30 is for setting the arm angle $\beta$ in the excavation posture. That is, when the arm angle at a predetermined excavating posture is $\beta o$, the arm angle setter 30 sets this angle $\beta o$ and sends out the corresponding signal $E\beta o$.

A bucket angle setter 31 is for setting the bucket angle $\gamma$ in the excavation posture. That is, when the arm angle $\beta o$ is set in the arm angle setter 30, the bucket angle setter 31 sets the bucket angle $\gamma o$ for said arm angle $\beta o$ and sends out the corresponding signal $E\gamma o$ .

Upon receipt of the automatic control command signal $e_c$, manual-auto return switches 36 and 37 of a switch device 35 is switched from contact a to contact b.

When excavation is ready, the boom 2, the arm 3 and the bucket 4 take such relative position to each other as shown in FIG. 1, in which the bottom surface 4*b* of the bottom 4*a* of the bucket 4 flatly contacts with the excavation surface. At this time, the bottom cylinder 8 is being expanded and therefore the bottom 4*a* of the bucket 4 is being closed. The manual-auto changeover switch 16 is being switched to "manual" side and therefore the automatic control selection signal Es is not being sent out. Accordingly, the automatic control command signal $e_c$ is not sent out from the control circuit 20 and the manual-auto return switches 36 and 37 of the switch device 35 are switched to contact a, respectively, thereby enabling the bucket 4 to be manually controlled.

In the above state, when an operator operates the arm lever 11 and the bucket lever 12, the lever control signals Ea and Eb are sent out corresponding to the lever angles of these levers 11 and 12, and applied, via amplifiers 40 and 41, to hydraulic control valves 50 and 51, respectively. These hydraulic control valves 50 and 51 expands the arm cylinder 6 and the bucket cylinder 7 according to the signals Ea and Eb, respectively, thereby the bucket 4 is pushed forward horizontally (in the direction of arrow A in FIG. 1) for excavation.

When the excavation ends, the operator stops operating the arm lever 11 and the bucket lever 12, and then starts operating the boom lever 13 and the rotation lever 15. The lever control signals Ec and Ef are sent out corresponding to the operation of these levers and are applied to amplifiers 42 and 44. Hydraulic control valves 52 and 54 are actuated in accordance with the signal Ec and Ef which are amplified through the amplifiers 42 and 44. These valves 52 and 54 then drive the boom cylinder 5, the rotation cylinder (not shown in the drawings) so as to raise the bucket 4 to a predetermined height while rotating it in the direction where a dump truck (not shown in the drawings) is waiting in the predetermined place, thus bringing the bucket 4 right above the dump truck.

Then the operator operates the bottom lever 15 to the bottom split position. In response to this lever operation, the signal Ed is output, which actuates hydraulic control valve 53 and drives the bottom cylinder 8, thereby splitting the bottom of the bucket 4 so as to dump the soil on said dump truck.

By taking the procedure as described above, the work from excavation through dumping is carried out.

When the semi-automatic control according to this invention is to be performed for the operation to return the bucket from the dumping posture to the original excavation posture, the manual-auto changeover switch 16 should be switched to "auto". After completion of the dumping, the operator controls only the bottom lever 14, the rotation lever 15 and the boom lever 13 so as to close the bottom of the bucket 4 and lower the boom 2 while rotating the rotation body 1*a*. With the aid of the arm angle setter 30 and the bucket angle setter 31 which memorize the original excavation position of the bucket, the bucket 4 can be brought back into the original excavation posture.

The detail of the control circuit 20 is shown in FIG. 2 in which a comparator 20*a* compares the lever operation signal Vc of the boom lever 13 with a first set value and sends out output "1" when the boom 2 is made in the downward condition and a comparator 20*b* compares the lever operation signal Vd of the bottom lever 14 with a second set value and sends out output "1" when the bottom of the bucket is opened. Comparators 20*c* and 20*d* input the lever operation signal Vf of the rotation lever 15 and compare this signal Vf, in case of the comparator 20*c*, with a third set value and sends out output "1" when the rotation lever 15 is operated for rightward rotation and in case of the comparator 20*d*, with a fourth set value and sends out output "1" when the rotation lever 15 is operated for leftward rotation.

Each one of the two input terminals of AND circuits 20*e* to 20*h* is respectively connected to the output of the comparator 20*a* to 20*d* and each of the other input terminals of the AND circuit 20*e* and 20*f* is connected. to be applied to the operation signal Vc of the boom lever 13 and the operation signal Vd of the bottom lever 14, respectively. Both of the other input terminals of the AND circuit 20*g* and 20*h* are connected to be applied to the operation signal Vf of the rotation lever 15. The output terminals of these AND circuits 20*f*, 20*g* and 20*h* are connected, via NOT circuits 20*i*, 20*l* and 20*m*, to the set inputs of flip-flop circuits F1, F1 and F3, respectively. Each of the set outputs of these flip-flop circuits F1 to F3 and the output of the AND circuit 20*e* are applied to the input of an AND circuit 20*k*. These flip-flop circuits are a type which is triggered with the input signal "0". All of the flip-flop circuits are made reset when the output of the AND circuit 20*e* becomes "0". The remaining one input terminal of the AND circuit 20*k* is connected to the output of the manual-auto changeover switch 16. This switch 16 is being switched so a to produce output signal "1" when the semi-automatic excavation-posture return according to this invention is desired to be performed.

Let us assume the case in which the dumping place is located on the right side from the excavation place. When the rightward rotation is performed with the rotation lever 15, the output of the comparator 20*c* becomes "1" as well as the operation signal Vf, then the output of the AND circuit 20*g* becomes "1" and the flip-flop circuit F2 turns into the set state. Subsequent to this, when the bucket 4 comes to the dumping place, the rotation lever 15 is set to the neutral position and the bottom lever 14 is operated so as to split the bottom of the bucket 4. Then the output of the comparator 20*b* become "1" as well as operation signal Vd, thereby the output of AND circuit 20*f* becomes "1", which, being inverted through the NOT circuit 20*i*, turns the flip-flop circuit F1 to the set state. After completion of the dumping, leftward rotation is performed by means of the rotation lever 15. By this operation the output of the comparator 20*d* becomes "1", which, being inverted through the AND circuit 20*h* and NOT circuit 20*m*, turns the flip-flop circuit F3 to the set state. Therefore, when the boom lever 13 is controlled downward, the output of the comparator 20*a* becomes "1" and thereby the output of the AND circuit 20*e* becomes "1" thus the output of the AND circuit 20*k* becomes "1", that is, the automatic control command signal $e_c$ becomes produced. This signal $e_c$ switches the switches 36 and 37 to the position as shown in FIG. 2 so as to enable automatic control of the arm cylinder 6 and bucket cylinder 7. That is to say, the arm cylinder 6 and the bucket cylinder 7 are automatically controlled in accordance with a deviation signal $\Delta e\beta$ corresponding to the deviation between outputs of an arm angle detector 60 and the arm angle setter 30, and a deviation signal $\Delta e\gamma$ between a bucket angle detector 61 and the bucket angle setter 31, respectively.

When the rotation body 1*a* returns to the original excavation posture, the rotation lever 15 is set to the neutral position and when the bucket 4 is brought back to the original excavation posture, the boom lever 13 is set to the neutral position. Then, the operation signal Vc becomes "0" and the output of the AND circuit 20*e* becomes "0", thereby all of the flip-flop circuits F1 to F3 are made to the reset state and consequently the output of the AND circuit 20*k* becomes "0".

By taking the above-described procedures, the bucket is swiftly brought back to the original excavation posture, thus becoming ready for another excavation.

What is claimed is:

1. A semi-automatic hydraulic excavator which includes a boom, an arm and a bucket having a movable bottom, said excavator comprising:

an arm control means for controlling the arm of said excavator automatically and manually;

a bucket control means for controlling the bucket of said excavator automatically and manually and;

one or more additional control means for manually controlling additional elements of the excavator, wherein the additional control means includes means for rotating the excavator under control of a rotation lever, means for moving the bucket bottom under control of a bottom lever and means for moving the boom under control of a boom lever;

detection means for producing signals representing rotation lever directional movement, bottom lever movement and boom lever movement;

an automatic control circuit which controls, upon detection of a signal corresponding to the fact that said excavator has completed a predetermined work procedure, said arm control means and said bucket control means to place them in an automatic control mode; wherein said automatic control circuit logically combines signals from the detection means respectively corresponding to the facts that the rotation lever is operated in one direction, said rotation lever is then operated in the reverse direction, the bottom lever is operated and that the boom lever is operated downward;

said arm control means being designed to control said arm during the automatic control mode so that an arm angle thereof becomes coincident with a fixed preset value corresponding to an original excavation posture, said bucket control means being designed to control said bucket during the automatic control mode so that a bucket angle thereof becomes coincident with a preset value corresponding to the original excavation posture, whereby, upon completion of dumping work, said bucket is swiftly brought back to the original excavation posture by simultaneous manual operation of the additional control means and automatic operation of the arm control means and bucket control means.

2. A semi-automatic hydraulic excavator as claimed in claim 1 wherein said automatic control command signal producing circuit stops sending out said automatic control command signal during a period when said boom lever stops in the operation thereof.

3. In a hydraulic excavator of the type including a body, a boom movably attached to the body, an arm movably attached to the boom, and a bucket movably attached to the arm, the improvement wherein the excavator includes:

automatic arm control means for causing the arm to move to a fixed preset position;

automatic bucket control means for causing the bucket to move to a fixed preset position;

a switching circuit for switching control of the arm and bucket from manual control to control by the automatic arm control means and automatic bucket control means; and a detection circuit for determining when an excavation procedure has been completed and an operator has initiated movement of the excavator back toward a starting excavation posture said detection circuit thereupon providing an auto command signal to the switching circuit to thereby cause the excavator to switch from manual to automatic control of the arm and bucket, thereby facilitating swift return to the starting excavation posture after the completion of each excavation procedure.

4. The hydraulic excavator of claim 3 wherein the excavator is rotatable and the bucket includes a movable bottom which is opened to release the contents of the bucket, and wherein the detection circuit includes circuitry for providing a first detection signal indicating that the excavator has rotated from an excavation site toward a dumping site, a second detection signal indicating that bottom of the bucket has been opened to dump to contents of the bucket, a third detection signal indicating that the excavator has begun rotating from the dumping site back to the excavation site, and a fourth detection signal indicating that the boom is being moved, wherein the auto command signal is generated in response to the generation of the first through fourth signals.

* * * * *